United States Patent [19]

Nowak

[11] 4,410,140

[45] Oct. 18, 1983

[54] ATOMIZER AND METHOD

[75] Inventor: Leonard G. Nowak, Palmyra, Pa.

[73] Assignee: Hauck Manufacturing Company, Lebanon, Pa.

[21] Appl. No.: 259,071

[22] Filed: Apr. 30, 1981

[51] Int. Cl.[3] ..... F23D 11/16

[52] U.S. Cl. ..... 239/419.3; 239/422; 239/425; 239/426

[58] Field of Search ..... 239/419.3, 422, 427.3, 239/425, 427, 426, 424.5, 427.5, 423, 428, 406, 590.5, 592, 597

[56] References Cited

U.S. PATENT DOCUMENTS

| | | | |
|---|---|---|---|
| 2,551,276 | 5/1951 | McMahan | 239/400 |
| 2,813,754 | 11/1957 | Zielinski | 239/592 X |
| 3,383,054 | 5/1968 | Nugarus | 239/597 |
| 3,758,258 | 9/1973 | Kolhi . | |
| 3,765,609 | 10/1973 | Robic | 239/405 |
| 3,897,007 | 7/1975 | Roy | 239/400 |
| 3,912,164 | 10/1975 | Lefebvre et al. | 239/400 X |
| 3,980,233 | 9/1976 | Simmons et al. . | |
| 4,139,157 | 2/1979 | Simmons | 239/400 |
| 4,171,777 | 10/1979 | Behr | 239/422 |
| 4,267,979 | 5/1981 | Lomax | 239/426 X |

FOREIGN PATENT DOCUMENTS

| | | | |
|---|---|---|---|
| 1020942 | 2/1953 | France | 239/422 |

*Primary Examiner*—Andres Kashnikow
*Assistant Examiner*—Paul A. Sobel
*Attorney, Agent, or Firm*—Finnegan, Henderson, Farabow, Garrett & Dunner

[57] ABSTRACT

An oil burner atomizer and method for light and heavy fuel oils where the oil is spread circumferentially of a number of oil delivery bores and two heavy oil flows are formed for each delivery bore. The oil flows are atomized in low-pressure primary air. The atomizer includes an annular low-pressure oil ligament formation zone upstream of the initial atomizing air flow.

19 Claims, 6 Drawing Figures

Fig. 1
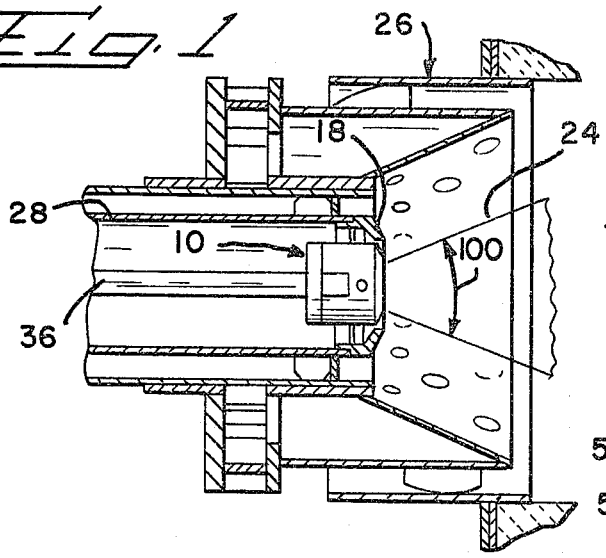
Fig. 6
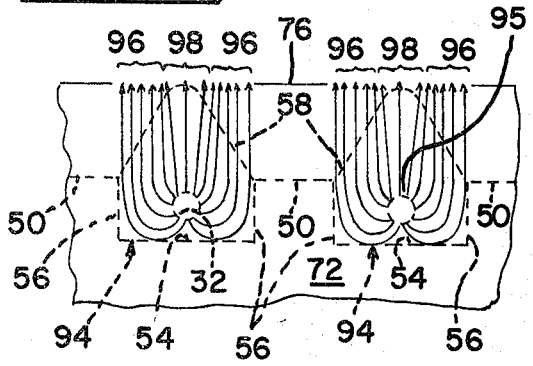
Fig. 2
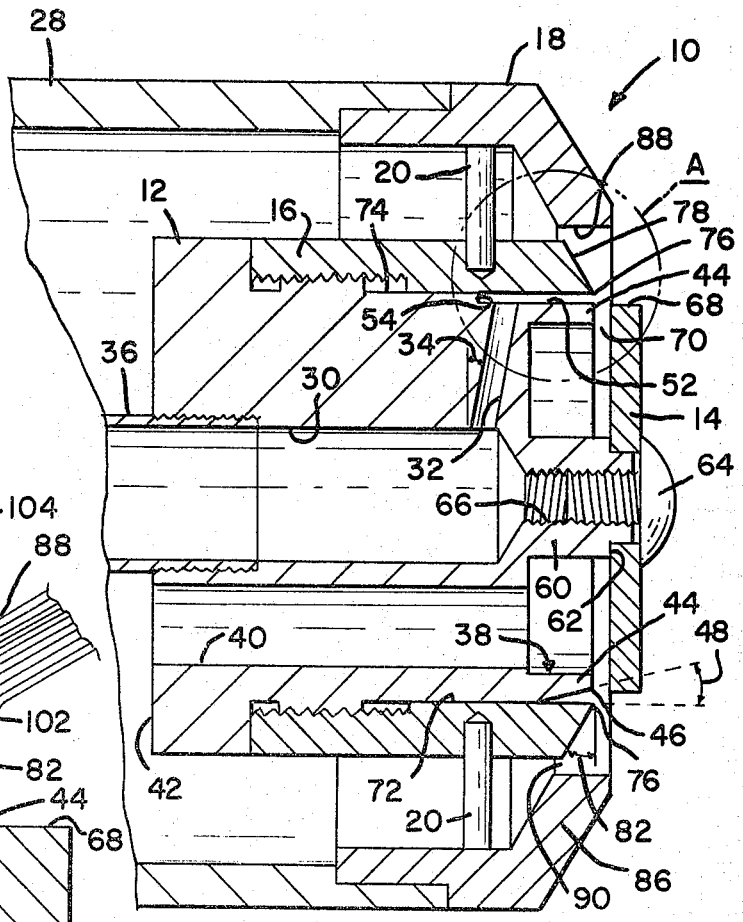
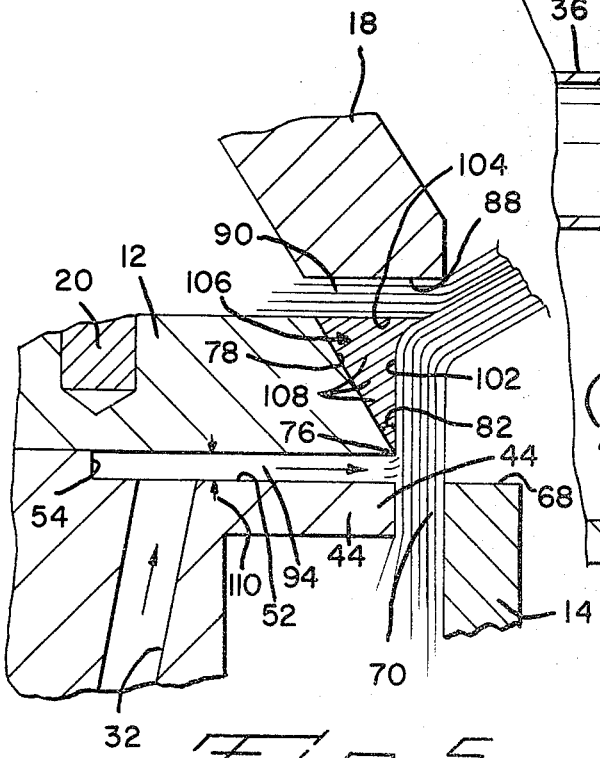
Fig. 5

ATOMIZER AND METHOD

The invention relates to low-pressure fuel oil atomizers and methods used in various types of conventional industrial oil burners. Conventional atomizers are shown in U.S. Pat. Nos. 3,758,258 and 3,765,609.

The present atomizer atomizes light and heavy fuel oils using low-pressure primary air. The oil is flowed to the atomizer through an axial oil pipe and thence outwardly from the axis of the atomizer through a series of fuel bores to a number of circumferentially spaced spreading chambers. The oil flowing into each chamber is spread into a pair of axially downstream flowing outer streams located to either side of the bore and a relatively light center stream. By spreading the oil in this manner it is possible to flow a nearly circumferentially uniform stream of oil into an outwardly expanding radial flow of inner primary air for improved atomization.

The inner primary air flows through a series of air flow bores formed in the body of the atomizer, each bore extending between an adjacent pair of fuel feed bores. The air flow bores end at an annular plenum chamber which equalizes the pressure at a circumferential air flow gap located immediately downstream of the oil streams being discharged from the spreading chambers. In this way, the spread oil is efficiently broken up into particles and is entrained with the radially outward flow of inner primary air.

Low-pressure outer primary air flows downstream through a gap between the main atomizer body and a primary air nozzle. This air flows axially downstream and combines with the radially outwardly flowing stream of inner primary air to further atomize the entrained fuel and form a hollow conical atomizer spray.

The oil is discharged into the radial outward stream of inner primary air over a circumferential edge on the inside of an upstream angled frustroconical surface. This surface, in cooperation with the upstream surface of the inner primary air flow and the inner surface of the outer axial primary air flow define an annular low-pressure ligament zone having a generally triangular cross section. During atomization heavy oil particles are drawn into this zone and are captured on the surface. The high turbulence in the low-pressure zone draws out ligaments of oil from the surface, which subsequently break up into small drops and are entrained in the surrounding flows, thereby improving atomization. This feature of the atomizer is particularly important in atomizing heavy viscous No. 6 fuel oil.

No. 6 fuel oil includes solids and impurities which clog many atomizers. The oil flow passages of the present atomizer have sufficient clearance to prevent clogging. This clearance does not reduce the efficiency of the atomizer.

Other objects and features of the invention will become apparent as the description proceeds, especially when taken in conjunction with the accompanying drawings illustrating the invention, of which there are two sheets and one embodiment.

IN THE DRAWINGS

FIG. 1 is a sectional view illustrating a typical illustration of an atomizer of the present invention within a burner;

FIG. 2 is a sectional view through the atomizer taken along line 2—2 of FIG. 3;

FIG. 5 is an enlarged view of a portion A of FIG. 2; and

FIG. 6 is a view of a portion of the cylindrical interior surface of the atomizer ring taken along curved line 6—6 of FIG. 3 showing the flow of oil on the ring during operation of the atomizer.

DESCRIPTION OF THE INVENTION

Figures 3, 4:
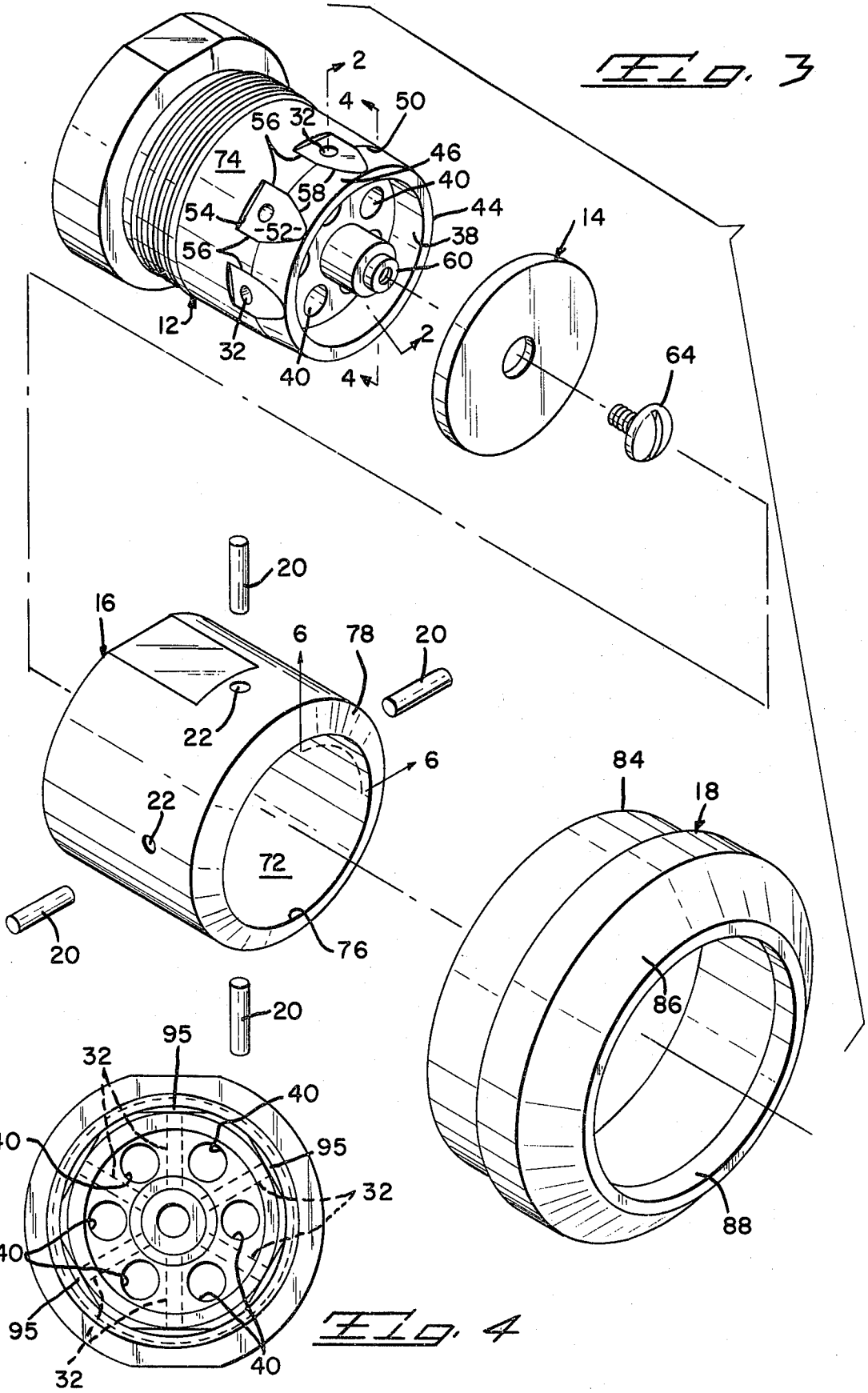
FIG. 3 is an exploded view of the atomizer.
FIG. 4 is a front view of the atomizer body taken along line 4—4 of FIG. 3.

Atomizer 10 includes a central body 12, plenum chamber disk 14, ring 16 surrounding the downstream end of body 12 and a primary air nozzle 18 surrounding the downstream end of the ring and body. The body and ring are axially located within nozzle 18 by four locating rods 20 carried in bores 22 of ring 16. The free ends of the rods have a sliding fit within the interior of nozzle 18.

As illustrated in FIG. 1, atomizer 10 delivers a hollow conical fuel spray 24 to the combustion chamber of a burner 26. Burner 26 is representative of a typical application for atomizer 10. The atomizer may be used in industrial heating burners, such as the type used for melting and treating metals, melting glassware and firing ceramics; for food drying furnaces such as those used to dry milk and instant potatoes; fertilizer drying furnaces and other like applications.

Atomizer 10 is installed with the primary air nozzle 18 attached to the downstream end of primary air pipe 28. Axial bore 30 extends into body 12 from the upstream end and terminates at six radial fuel feed bores 32 uniformly spaced apart from each other around the body. The bores 32 are spaced apart 60° in end view, as shown in FIG. 4. The bores are also angled downstream from bore 30 at an angle 34 of 10° from a radial plane, as shown in FIG. 2.

Axial oil pipe 36 within primary air pipe 28 is threaded into the upstream end of atomizer body bore 30 and extends through pipe 28 to a suitable source of combustion oil.

Annular plenum chamber 38 is formed in the downstream face of body 12. Six 60°-spaced air flow bores 40 extend through body 12 from the upstream face 42 thereof to the plenum chamber. See FIGS. 2 and 4. The bores 40 are located between bores 32 so that oil flowing through oil pipe 36 flows through bore 30 and bores 32 radially outwardly beyond the central plenum chamber 38. Bores 40 parallel the atomizer axis 41.

A cylindrical wall 44 extends around the downstream end of body 12 to define the outer boundary of plenum chamber 38. The outer surface 46 of wall 44 is beveled radially inwardly as illustrated in FIGS. 2 and 3 at an angle 48 of about 6° to the axis of atomizer 10. The outer surface of body 12 upstream of outer bevel wall 46 is cylindrical. The junction between the cylindrical and beveled outer surfaces is indicated by line 50 shown in FIG. 3.

A flat surface 52 is formed on the outer surface of the body 12 at each bore 32. The surfaces are parallel to the axis of the atomizer and extend from the downstream end of wall 44 upstream past line 50 and the end of each bore 32 to a shallow wall 54. The intersections between flats 52 and the outer surface of body 12 are defined by lines 56 to lines 50. The flats 52 are sufficiently deep that their intersections with the beveled outer surface 46 of wall 44 forms parabolic intersections 58 extending from the ends of line 56 to an apex at the downstream end of wall 44. The bores are directly upstream from the apexes of these lines. Axially extending disk support 60 extends downstream from the center of the plenum chamber 38 and includes a mounting step 62 located a distance downstream of the end of the wall 44. Disk 14 is secured on support 60 against step 62 by screw 64 threaded into threaded support bore 66. The radius of the disk 14 is the same as the outer radius of the downstream end of wall 44 so that the circumference 68 of the disk is immediately downstream from the outer surface of the body. Step 62 spaces the disk beyond the wall to provide a narrow circumferential gap 70 between the disk and body.

Ring 16 is threaded on the body 12 and includes a cylindrical downstream interior surface 72 having a sliding fit with the outer cylindrical surface 74 of the body 12 upstream of line 54. Surface 72 extends downstream to circular edge 76 located opposite the downstream end of body wall 44. The downstream end of ring 16 is beveled to provide an outwardly facing frustoconical surface 78 extending from the edge 76 to the outer surface 80 of the atomizer body and ring. Surface 78 extends upstream at an angle 82 of 30° to a radial plane.

The primary air nozzle 18 includes a cylindrical portion 84 joined to the downstream end of primary air pipe 28 and inwardly extending frustoconical portion 86 having an inner cylindrical surface 88 overlapping the outer surface 80 of the body and ring assembly to define a cylindrical primary air flow gap 90 surrounding and immediately upstream of frustoconical surface 78.

OPERATION OF ATOMIZER

In burner 26, or any other burner using atomizer 10, the primary air pipe 28 is connected to a source of pressurized primary air so that air flowing through the pipe is divided into inner primary air flowing through bores 40 into the plenum chamber 38 and outer primary air flowing through gap 90. About 35 percent of the total primary air flows through bores 40 and about 65 percent of the total primary air flows through the gap 90. The pressure of the primary air varies depending upon the viscosity of the fuel oil supplied to the atomizer. For instance, in one application the primary air may be pressurized at 16 ounces per square inch for light fuel oils such as No. 2 oil and may be pressurized at 24 ounces per square inch for heavy, viscous No. 6 fuel oil.

The atomizer effectively atomizes both heavy and light fuel oils using low-pressure primary air. The low-pressure primary air can be supplied by a conventional radial vane-type air compressor. High-pressure fuel atomizers require primary air which must be pressurized by expensive piston-type compressors.

Fuel oil supplied to atomizer 10 flows downstream through pipe 36 to axial bore 30 and then radially outwardly from the bore through the six spaced delivery bores 32. At high fire, oil is delivered to the atomizer at a pressure of about 2 to 5 pounds per square inch. Pressure is reduced at low fire.

At high fire, oil in each bore 32 flows across the spreading chamber 94 defined by flat 52 and ring surface 72 and hits the surface 72. FIG. 6 is a view of the interior surface 72 of the atomizer showing, in dotted lines, the positions of lines 50, 56 and 58; walls 54 and bores 32 on the other side of the chamber. The oil flows out chamber mouth 95.

As shown in FIG. 6, oil flowing outwardly of bore 32 hits surface 72 and, initially, flows radially outwardly away from the bore. Because the oil flows downstream as it moves along bore 32, it has downstream momentum and as a result initially a greater amount of oil flows downstream than flows laterally or upstream of the bore. The oil flowing downstream and slightly to either side of the bore flows directly to the edge 76. Oil flowing laterally or upstream from the bore 32 encounters wall 54 and junctions 56 between the ring and body and is deflected in a downstream direction as indicated by the flow lines in FIG. 6. Since a majority of the oil flowing out of the bore is initially deflected laterally or upstream of the bore and is flowed to either side of the bore by the spreading chamber, the oil flowing through the bore 32 and outwardly of the chamber past edge 76 includes two relatively heavy circumferentially spaced outer streams 96 and a relatively lighter central stream 98.

FIG. 6 illustrates the flow of oil through chamber 94 so that all of the oil flows in a downstream direction across edge 76. In some applications it may be desirable to adjust the pressure of the oil supplied to the atomizer, the thickness of the chamber between the flat and the ring and the angles of beveled outer wall 46 and bores 32 to achieve circumferentially spread oil flows.

Inner primary air flows through bores 40 to the plenum chamber 38. For efficient atomization, it is important that the air flowing through gap 70 and across the oil stream 96 and 98 have a maximum velocity. The plenum chamber assures that there is a nearly uniform pressure drop around the circumference of the gap 70. By providing a plenum chamber as shown the pressure drop around the circumference of the gap is uniform within a few percent.

The oil flowing from each spreading chamber 94 forms two heavy circumferentially spaced streams 96 passing ring edge 76. A thin stream 98 is located between the heavy streams. The primary air flowing radially outwardly through gap 70 shear atomizes the oil flowing outwardly past edge 76 and entrains the oil particles within the radially expanding flow. Outer primary air flowing axially downstream through gap 90 mixes with the radial outward flow to further shear atomize the entrained oil particles and form the hollow conical spray 24 illustrated in FIG. 1. The internal angle 100 for spray 24 may be adjusted by varying the relative axial and radial momentums of the flows passing through gaps 70 and 90. The shear atomization of the oil flowing outwardly of edge 76 by the radial flow through gap 70 is most active adjacent the edge 76.

Bevel surface 78 extends upstream from edge 76 and in cooperation with the upstream edge 102 of the radial flow and the radial inner edge 104 of the axial flow defines an annular low-pressure zone 106 having a generally triangular radial plane cross section as shown in FIG. 5. The rapidly moving radial and axial flows define the zone and reduce the pressure in the zone so that large droplets of oil carried past edge 76 are drawn into the zone and are collected on surface 78.

The turbulence in zone 106 and the rapid movement of the flows past the zone draw out the impacted oil from surface 78 to form long thin oil ligaments which ultimately break up into small droplets and are drawn into the inner and outer primary air flows. Lines 108 represent the ligaments formed on surface 78. The angle 82 of bevel surface 78 determines the number and size of the ligaments by determining the negative pressure of zone 106. The 30°-angle 82 performs better than 10° or 45° angle surfaces.

Sharp edge 76 is located radially outwardly of the end of wall 44 at the upstream side of the radial air flow. Preferably, the junction between surfaces 72 and 78 should be an edge as illustrated or a narrow flat surface lying in a radial plane in order to assure the junction does not impart upstream momentum to the radial flow. Such momentum would direct the radial flow upstream toward surface 78, thereby reducing the volume of the low-pressure zone and reducing the efficiency of the resultant ligament atomization.

As illustrated in FIG. 6, the spreading chambers 94 circumferentially distribute the oil in twelve heavy outer streams which are nearly equally circumferentially spaced around the atomizer. Relatively light central streams are provided between adjacent pairs of heavy streams. The circumferential spreading of the oil delivered to the radial atomizing air stream reduces the size of the oil droplets entrained in the stream and, consequently, improves atomization. This feature is particularly important when the atomizer is used with thick heavy residual No. 6 oil which is very difficult to atomize.

Conventional atomizers using a circumferential oil slot with oil delivered to the entire slot poorly atomize heavy oil, resulting in incomplete combustion and soot buildup. No. 6 oil includes impurities which tend to clog a narrow slot of this type and render the atomizer inoperative. The present atomizer efficiently atomizes both light and heavy oils. Clogging is avoided by maintaining a clearance of about 0.04 inch in the center of the spreading chambers so there is sufficient room in the chamber for sweeping out of impurities carried into the chamber with the oil.

In some applications of atomizer 10 having very high fuel comsumption, it is believed necessary to increase the oil flow bore angle 34 in order to impart increased downstream momentum to the oil flowing into the spreading chambers 94. This is because as the oil pressure is increased there is an increased tendency for the outer streams 96 to spread circumferentially beyond the chambers so that adjacent outer streams 96 merge together to form a single heavy stream between each spreading chamber. The result is six circumferentially-spaced very heavy oil streams. These streams are difficult to atomize. By providing more downstream momentum to the oil flowing into the spreading chambers the spreading of the outer streams is reduced and it is believed the desired twelve heavy stream flows are maintained.

The upstream mixing chamber walls 54 are spaced a distance beyond the oil delivery bores 32 to allow oil to flow circumferentially from the bores into the spreading chamber to be spread laterally and form the desired relatively uniform circumferential flow across edge 76. As shown, the walls 54 lie in a radial plane. The walls may be curved, each with an apex upstream of the bores 32 and ends joining lines 56. Also, the invention is not limited to the use of six circumferentially spaced expanding chambers. For a given application, a greater or fewer number of chambers may be provided as required.

As illustrated in FIGS. 2 and 6, the fuel feed bores open into the spreading chambers 94 a short distance from walls 54. In some applications, circumferential spreading may be improved by positioning the ends of the bores 32 at walls 54.

The spacing between lines 56 of adjacent spreading chambers 94 assures that the heavy flows 96 from adjacent chambers do not touch each other to coalesce and form six very heavy flows which would be difficult to atomize.

While I have illustrated and described a preferred embodiment of my invention, it is understood that it is capable of modification, and I therefore do not wish to be limited to the precise details set forth, but desire to avail myself of such changes and alterations as fall within the purview of the following claims.

What I claim my invention is:

1. A fuel atomizer for an industrial heating burner or the like comprising a body having an upstream end, a central fuel passage extending into the body from the upstream end, a plurality of fuel feed passages spaced circumferentially around the central passage and extending outwardly therefrom, a plurality of circumferentially spaced hollow spreading chambers each located at the outer end of a feed passage and including a mouth facing downstream and a spreading wall overlying the end of the fuel passage, the spreading wall extending circumferentially to each side of the feed passage, and an air delivery system for flowing atomizing air across the spreading chamber mouths whereby fuel oil flowed through said passages and into the spreading chambers flows to each side of the chambers and forms a pair of fuel streams located circumferentially of the feed passages for atomization by the air flow.

2. An atomizer as in claim 1 wherein the feed passage ends open through the radially inner spreading chamber walls, the spreading walls lie on a cylindrical surface and said inner spreading chamber walls are generally flat.

3. An atomizer as in claim 1 wherein said fuel passages are angled downstream.

4. An atomizer as in claim 1 wherein the fuel passages are angled downstream at about 10°.

5. An atomizer as in claim 1 wherein said air delivery system includes a radial air delivery gap located radially inward and downstream of the mouth of each spreading chamber and air passages in the body for delivery of air to the gaps to form radial outward flows across the mouths.

6. An atomizer as in claim 5 including an air nozzle surrounding the body and defining an axial air delivery gap outwardly of each spreading chamber and an upstream angled ligament generating surface at each spreading chamber located upstream of the radial air delivery gap and radially inwardly of the axial delivery gap.

7. An atomizer as in claim 5 wherein the air delivery system includes a circumferential gap extending around the atomizer, a plenum chamber directly communicating with the gap and a plurality of air flow bores extending from the upstream end of the body to the plenum chamber, each air flow bore being located between a pair of adjacent feed bores.

8. A fuel oil atomizer for an industrial heating burner or the like comprising a body having upstream and downstream ends, a ring surrounding the downstream end of the body, a plurality of oil spreading chambers formed in the interface between the ring and body, each chamber including a downstream opening mouth, an outer wall on the ring and an inner wall on the body, an oil delivery system including a plurality of oil feed passages in the body, each passage having an end opening into a spreading chamber through the circumferential center of a spreading chamber wall, and an air delivery system including a gap adjacent each spreading chamber mouth for flowing air across the mouth whereby fuel delivered to each spreading chamber flows radially outwardly of the end of each passage and is circumferentially spread within the chamber to form a pair of oil streams to each side of the end of each oil feed passage, the air flowing through said gaps intersecting and atomizing said streams.

9. An atomizer as in claim 8 including a central plenum chamber formed in the downstream end of said body, a disk overlying the plenum chamber and spaced downstream therefrom a short distance to define a circumferential air flow gap extending around the body downstream of the spreading chambers, the air delivery system including a plurality of air passages extending from the upstream end of the body to the plenum chamber, the oil delivery system including a central fuel passage joining the feed passages and said feed passages extend from the central fuel passage outwardly between adjacent air flow passages to end opening in the inner walls of said mixing chambers.

10. An atomizer as in claim 8 wherein the air delivery system flows air radially outwardly across said mouths and including an inwardly tapered frustroconical surface extending from the mouths to the downstream end of the body, the ring extending to the downstream end of the body and the inner walls of the spreading chambers comprising flat surfaces on the body extensions of such surfaces intersecting the frustroconical surface.

11. An atomizer as in claim 8 wherein said feed passages are angled downstream at said ends to impart downstream momentum to the fuel flow into the spreading chambers.

12. An atomizer as in claim 8 including an outer air delivery system surrounding the body and ring for forming an axial flow of air past the ring outwardly of the spreading chambers, and a ligature forming surface on the downstream of said ring overlying each spreading chamber, said ligature surface being angled upstream from the inside of the ring to the outside of the ring, the air delivery system including a gap located inwardly of each spreading chamber for forming a radial outward flow of air through the gaps to entrain and atomize fuel oil delivered from the said spreading chambers whereby the radial and axial air flows reduce the pressure adjacent ligature surfaces, particles of oil are drawn onto the surfaces and are ligature-atomized therefrom.

13. An atomizer as in claim 12 wherein the downstream end of the ring comprises a frustroconical surface extending around the atomizer, said outer air delivery system including an air nozzle located circumferentially outwardly of said ring and spaced from the ring a short distance to form circumferential axial flow gaps and the air delivery system includes a circumferential gap and a plenum chamber communicating with such gap.

14. An atomizer for an industrial heating furnace or the like including a body having a face, a plurality of spreading chambers arranged side by side on the face, each chamber having a spreading wall, an opposite wall overlying the spreading wall, the walls joining at the edges of the chamber, and a mouth opening at the face, a fuel delivery system including a plurality of feed passages each having an end in an opposite wall of a spreading chamber located approximately midway between the chamber side edges, and an air delivery system including a first air flow gap located to one side of each mouth for directing a flow of air across the mouth whereby oil delivered to the chamber from the feed passages is spread toward the chamber side edges by the spreading wall and flows outwardly of the mouths in flows to each side of the passage end for atomization by air flowing through the gaps and across the mouths.

15. An atomizer as in claim 14 including a second air flow gap located on the other side of each of said mouths away from said first gap and oriented to direct a flow of air to intersect with the flow of air from said first gap, and a ligature surface located between each mouth and a second gap, said flows reducing the pressure adjacent the ligature surface for ligature atomization of oil captured on the surface.

16. An atomizer as in claim 15 wherein the ligature surface angles away from the direction of the first air flow at about 30°.

17. An atomizer as in claim 15 wherein the spreading chambers are arranged in a closed line of the face.

18. An atomizer as in claim 15 wherein the spreading chambers are arranged in a circle on the face.

19. The method of atomizing fuel oil in an industrial heating burner or the like comprising the steps of:

a. flowing a single stream of oil through an opening in one wall of a generally flat spreading chamber having opposed walls, edges and a mouth;

b. spreading the oil at least partially circumferentially outwardly of the opening along the opposite wall of the spreading chamber;

c. collecting major portions of the circumferential oil flow at the two edges of the spreading chamber to each side of the opening;

d. flowing two spaced oil flows through the mouth to each side of the opening and outwardly of the chamber;

e. directing a first flow of air from one side of the mouth across the oil flows to entrain and atomize the oil;

f. directing a second flow of air downstream on the other side of the mouth to intersect the first stream and further atomize and mix the oil in the air;

g. forming a low-pressure zone between the mouth and second air flow and upstream of the first air flow; and h. collecting oil droplets on a ligature surface at the low-pressure zone and ligature atomizing the oil on the surface.

* * * * *